United States Patent [19]

Marish

[11] Patent Number: 4,576,250

[45] Date of Patent: Mar. 18, 1986

[54] LADDER STOP

[76] Inventor: Robert Marish, 330 Boro Rd., Primos, Pa. 19018

[21] Appl. No.: 740,585

[22] Filed: Jun. 3, 1985

[51] Int. Cl.[4] ..... E06C 7/46

[52] U.S. Cl. ..... 182/108

[58] Field of Search ..... 182/107, 108, 93, 104

[56] References Cited

U.S. PATENT DOCUMENTS

| | | | |
|---|---|---|---|
| 416,226 | 12/1889 | Kidder | 182/107 |
| 530,374 | 12/1894 | Wilkins | 182/107 |
| 776,446 | 11/1904 | Williamson | 182/107 |
| 1,352,566 | 9/1920 | Voll | 182/107 |
| 1,907,828 | 5/1933 | Kelly | 182/107 |
| 2,145,619 | 1/1939 | Brown | 182/107 |
| 2,449,609 | 9/1948 | Linder | 182/107 |
| 2,523,535 | 9/1950 | Little | 182/107 |

FOREIGN PATENT DOCUMENTS

| | | | |
|---|---|---|---|
| 2509782 | 1/1983 | France | 182/107 |

*Primary Examiner*—Reinaldo P. Machado
*Attorney, Agent, or Firm*—Barbara C. Siegell

[57] ABSTRACT

An improved device for preventing ladders that are positioned against structures from slipping, is disclosed. The invention includes a pointed vertical member, adapted for insertion in the ground, in snow or in other non-solid surfaces, connected to two projecting arm members that are adapted to fit about ladder legs and over ladder feet, where present, providing an inexpensive and improved means for avoiding ladder slippage.

5 Claims, 4 Drawing Figures

LADDER STOP

BACKGROUND OF THE INVENTION

1. Field of Invention

The present invention relates to an improved and useful safety device for preventing the lower portion of ladders, that are positioned against structures, from slipping, resulting in injury to the user or damage to property. The device of this invention is adapted for use as an anchor on nonsolid surfaces, such as grass, snow or soil.

In the use of ladders on slippery surfaces, or, especially, on hills, the base portion of the ladder sometimes slips outward causing serious accidents. While various ladder staying devices exist in the prior art, some of these are cumbersome to use or expensive to purchase and install. It is, therefore, an object of the present invention to provide a safe, and economical ladder staying apparatus. It is a further object of the invention to provide a ladder staying device that can be easily carried and can be installed using any suitable hammering device or hard weight.

2. Description of the Prior Art

A number of ladder safety and stabilizing devices appear in the patent literature. U.S. Pat. No. 2,145,619 teaches a device for anchoring a ladder into the ground, which is bracketed on the ladder legs and which has spikes that slide on guides located within the brackets, into a downward position so that the spikes can be forced into the ground.

U.S. Pat. No. 776,446 has a horizontal member with sockets, into which the lower ends of the ladder rails slide; a penetrating anchor device is located vertically, in the center of the horizontal member and is screwed into the ground as an anchor.

U.S. Pat. No. 2,523,535 teaches a device that hooks on to the center of a low rung of a ladder and provides an adjustable ladder anchor for use in areas where the positioning of the ladder itself must be on a hard surface but where the anchor must exist at a distance and can be installed in a place where there is nonsolid ground.

U.S. Pat. No. 2,449,609 teaches a ladder stabilizing device that screws on the inner leg of a ladder and is able to assume positions on the bottom of the ladder to conform to the different angular positions that the ladder is placed in according to its various uses. Various other patents such as U.S. Pat. Nos. 1,907,828, and 530,374 employ stabilizing devices which increase the horizontal base of the ladder with or without shallow ground anchors. The present invention differs from the previous patents cited in several ways. It requires no installation on the ladder prior to use, is inexpensive, has no moving parts and is easy to transport. Also, unlike most of the other ladder stopping devices reviewed, the ladder stop of the present invention is positioned to the back of each ladder leg so as to provide support for the ladder at the points where slippage is most likely to occur. In addition, the present invention can be used both with ladders that are footed and with ones that are not.

BRIEF DESCRIPTION OF THE DRAWINGS

FIG. 1(*b*) shows an embodiment wherein the vertical anchoring member is a cylindrical pipe and where a handle made of a solid steel round has been positioned on top of said cylindrical pipe.

Figure 1A:
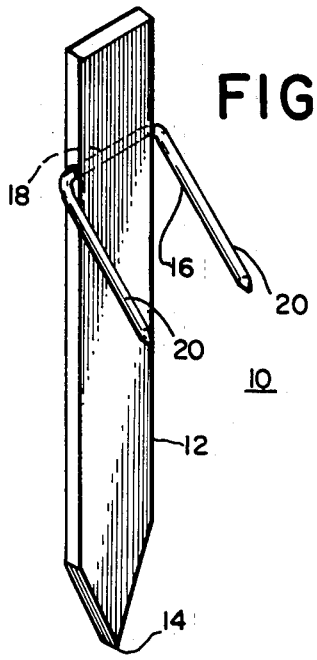
FIG. 1(*a*) shows an embodiment wherein the vertical anchoring member is a rectangular spike.

In that the present invention is subject to many variations, modifications and changes in detail, it is intended that all subject matters discussed in the specifications and shown in the drawings be interpreted as illustrative and not as limiting this invention.

DETAILED DESCRIPTION OF THE PREFERRED EMBODIMENTS

Figure 1B:
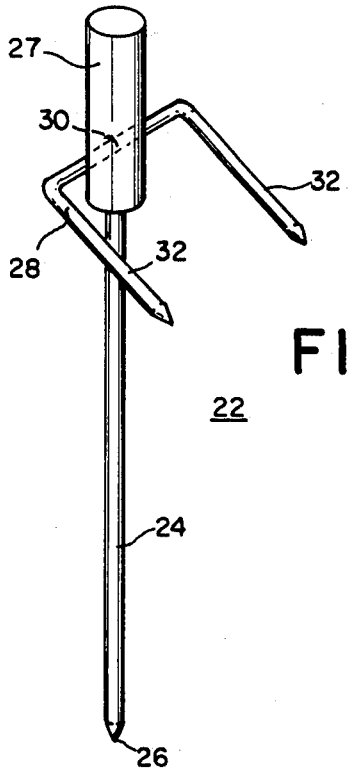

Referring to the drawings in detail:

FIGS. 1(*a*) and 1(*b*) designate front views of two embodiments of the invention. In FIG. 1(*a*), ladder stop 10 has a rectangular vertical anchoring member 12, that is approximately 16 to 18 inches in length, with a point thereon 14, at one end, for inserting said anchoring member into a nonsolid surface. A bracket 16, the center of which is 18, is, welded or otherwise secured to said vertical member. Ends 20 of said bracket are bent downward and are parallel. They form arm members which are parallel to each other and are positioned at equal angles ranging from 15° to 45° with the plane of the surface of said vertical member.

In FIG. 1(*b*), ladder stop 22 has a cylindrical vertical anchoring member 24, approximately $\frac{3}{8}$ in diameter, that is approximately 16 to 18 inches in length, with a point thereon 26, for inserting said anchoring member into a nonsolid surface. The nonpointed end of anchoring member 24 has a solid cylindrical handle member 27 affixed thereto. Said handle member is of an approximate $1\frac{1}{4}$ inches in diameter and 4 inches in height. A bracket 28, the center of which is welded or otherwise secured to the said solid cylindrical handle 27, is positioned on the said handle at attachment point 30, located directly above the point at which the vertical anchoring member and handle are connected to each other. Ends 32 of said bracket are bent downward and are kept parallel so that they form equal angles of approximately 15° with plane of the anchoring member, shown in FIG. 1(*b*). When installed, the handle is located on top of the ladder foot, thereby clamping the foot toward the ground.

Figure 2:
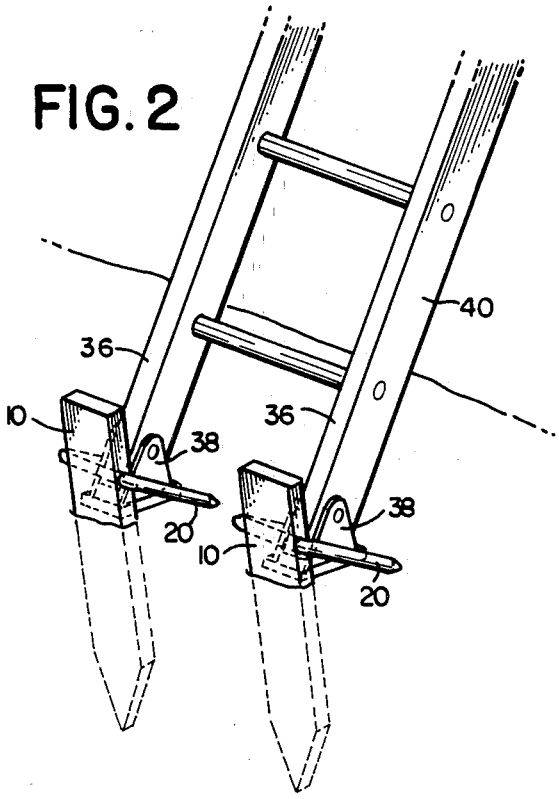
FIG. 2 is a front elevation of a segment of a ladder with the slippage preventing device inserted in a nonsolid surface in back of each ladder leg.

FIG. 2 shows ladder 40 positioned against a structure and stop 10 inserted in the ground or other nonsolid surface in back of each ladder leg 36. Arms members 20 fit on either side of each leg 36 and over ladder feet 38.

Figure 3:
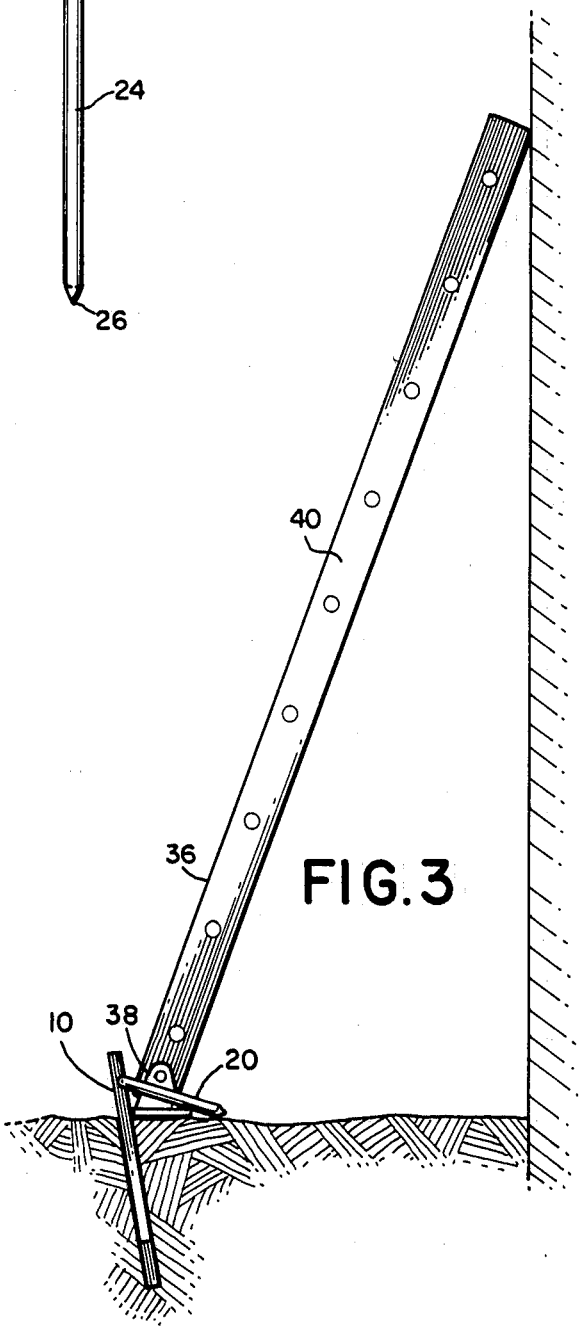
FIG. 3 is a side elevation of the ladder legs with the slippage preventing device inserted in back of a ladder leg and showing the projecting arm members positioned over the ladder's feet.

FIG. 3 is a side view of ladder 40. Ladder leg 36 has ladder stop 10 positioned in back, with arm members 20 positioned over ladder feet 38.

What is claimed is:

1. A device for effectively preventing ladder slippage for use with ladders that are positioned against structures, for use on non solid surfaces, consisting of a pointed anchoring spike upon which are mounted a pair of parallel arms wherein the said parallel projecting arms are formed from a single bracket welded to the back of said spike and bent downward to an angle ranging from 10° to 45° in reference to said spike.

2. The apparatus, as described in claim 1, wherein the spike and projecting arms are made of metal.

3. A device for effectively preventing ladder slippage, for use with ladders that are positioned against structures, for use on nonsolid surfaces, comprising:

a. A cylindrical shaped, pointed anchoring member, for insertion in a nonsolid surface;

b. A cylindrical shaped handle member of a diameter larger than said anchoring member, connected to the anchoring member at said anchoring member's non pointed end;

c. A pair of parallel projecting arms that are mounted on said handle member at a point near the joinder of said anchoring member and said handle member and which are adapted to receive a ladder leg whereby said ladder leg is restrained against backward slippage.

4. The apparatus described in claim 3 wherein the pointed anchoring member is 16 to 18 inches long.

5. The apparatus described in claim 3 wherein the spike and projecting arms and handle are made of metal.

* * * * *